US010647493B2

(12) United States Patent
Roesler

(10) Patent No.: US 10,647,493 B2
(45) Date of Patent: May 12, 2020

(54) MULTI-PART PACKAGING WITH SEALED CONNECTION JOINT

(71) Applicant: Thiemo Roesler, Wangen (DE)

(72) Inventor: Thiemo Roesler, Wangen (DE)

(73) Assignee: ROESLER IP GMBH (DE)

( * ) Notice: Subject to any disclaimer, the term of this patent is extended or adjusted under 35 U.S.C. 154(b) by 0 days.

(21) Appl. No.: 15/182,876

(22) Filed: Jun. 15, 2016

(65) Prior Publication Data

US 2016/0368679 A1 Dec. 22, 2016

(30) Foreign Application Priority Data

Jun. 16, 2015 (DE) ..... 10 2015 007 716

(51) Int. Cl.

| | |
|---|---|
| ***B65D 55/06*** | (2006.01) |
| ***B65D 81/20*** | (2006.01) |
| ***B65D 41/02*** | (2006.01) |
| ***B65D 55/08*** | (2006.01) |
| ***B65D 85/12*** | (2006.01) |

(52) U.S. Cl.

CPC ..... *B65D 81/2076* (2013.01); *B65D 41/02* (2013.01); *B65D 55/0818* (2013.01); *B65D 85/12* (2013.01)

(58) Field of Classification Search

CPC .... B65D 81/2076; B65D 85/12; B65D 41/02; B65D 55/0818

USPC ..... 220/4.21, 260; 40/312, 638; 428/34.2, 428/35.7, 347; 206/459.5; 156/277

See application file for complete search history.

(56) References Cited

U.S. PATENT DOCUMENTS

| | | | | |
|---|---|---|---|---|
| 478,947 | A * | 7/1892 | Ames, Jr. | B65D 9/34 206/37 |
| 3,334,776 | A * | 8/1967 | Ellis | B65D 55/0818 220/260 |
| D478,947 | S | 8/2003 | Lu | |
| 7,537,116 | B2 | 5/2009 | Roesler | |
| 2007/0181573 | A1* | 8/2007 | Dawson | A45C 11/00 220/4.21 |

(Continued)

FOREIGN PATENT DOCUMENTS

| | | |
|---|---|---|
| CN | 2256408 Y | 6/1997 |
| DE | 8703713 U1 | 4/1988 |

(Continued)

*Primary Examiner* — Andrew T Kirsch
*Assistant Examiner* — Elizabeth J Volz
(74) *Attorney, Agent, or Firm* — Dentons Cohen & Grigsby P.C.

(57) ABSTRACT

A multi-part packaging including at least two packaging sleeves and a sealing film that seals a connection joint between the packaging sleeves is disclosed. One of the two packaging sleeves includes an end region having a reduced diameter that can be inserted into an accommodation region of the other packaging sleeve forming the connection joint that runs in the circumference direction which can be sealed in an air-tight manner by means of the sealing film that is wound onto the connection joint in the circumference direction and sealed thereon. Edges of the sealing film overlap in a coverage region that runs parallel to a longitudinal axis of the packaging sleeves in the axial direction, wherein a first overlap edge conforms to a starting edge of a second overlap edge to form the air-tight seal.

19 Claims, 7 Drawing Sheets

(56) References Cited

U.S. PATENT DOCUMENTS

Figures 1, 2, 3, 4:
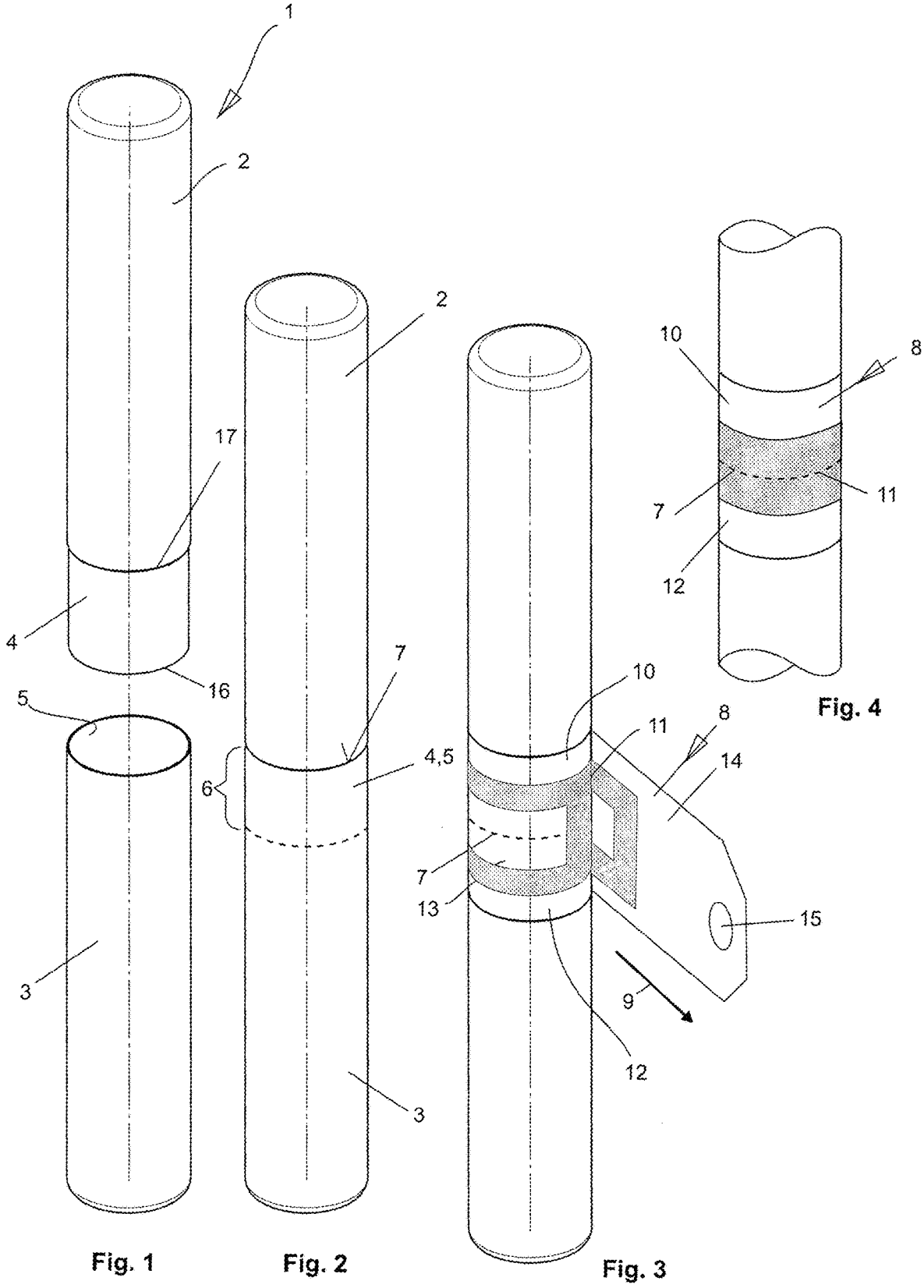

| | | | | |
|---|---|---|---|---|
| 2013/0221081 | A1* | 8/2013 | Conaghan | G09F 3/04 235/3 |
| 2013/0312599 | A1 | 11/2013 | Cover | |
| 2014/0262903 | A1* | 9/2014 | Mitten | B65D 55/06 206/459.5 |

FOREIGN PATENT DOCUMENTS

| | | | |
|---|---|---|---|
| EP | 1417139 | B1 | 11/2005 |
| WO | 1994/021530 | A2 | 9/1994 |
| WO | 2003/013974 | A1 | 2/2003 |
| WO | 2003/057590 | A2 | 7/2003 |

* cited by examiner

MULTI-PART PACKAGING WITH SEALED CONNECTION JOINT

The invention relates to a multi-part packaging with a sealed connection joint, in accordance with the preamble of claim 1.

The invention proceeds from an at least two-part packaging, which, in the preferred application case, consists of two packaging sleeves that can be inserted into one another, wherein the one sleeve is dimensioned in such a manner that it can be inserted into the interior of an opposite packaging sleeve, together with a related connection sleeve.

Such composite packaging sleeves, which are inserted into one another, have become known to a great extent.

In particular, such packaging sleeves, which can be inserted into one another and are preferably configured in two parts, are known as cigar packaging, wherein the one, first packaging sleeve, which is round-cylindrical, has a second connection sleeve assigned to it—which is reduced in diameter at least in the insertion region.

It is also known to glue a label over the overlap region (connection joint) of the two packaging sleeves that are inserted into one another, in such packaging, in order to prevent unintentional opening of the two packaging sleeves.

Likewise, it is known to cover the overlap region of the two packaging sleeves that are inserted into one another with a shrink-wrap film, which is configured, for example, as a heat-shrinkable plastic, in order to allow shape-fit wrapping of the two packaging sleeves that are inserted into one another, at least in the coverage region.

All the labels or wrappings that are used and disposed in the connection region between the two packaging sleeves merely have the purpose of preventing the packaging sleeves from being unintentionally pulled apart. Up to the present, however, it is not known to undertake gas-tight closure of such packaging sleeves, in order to use such packaging sleeves for medical application purposes.

The invention is therefore based on the task of further developing a multi-part packaging, consisting of at least two packaging sleeves that can be inserted into one another, in such a manner that the connection region is absolutely air-tight, in order to achieve a sealed atmosphere in the multi-part packaging.

It is therefore the purpose of the invention to provide a multi-part packaging particularly for medical instruments, devices, tools, and the like, in the interior of which a sterile protective atmosphere can be created, in that after air-tight closure of the coverage joint between the packaging sleeves that are inserted into one another, the air volume enclosed there is made germ-free.

This can be done, for example, by means of irradiation with gamma rays, in order to make the inner atmosphere germ-free. Likewise, it is possible to treat the multi-part packaging, the parts of which have been inserted into one another and sealed in air-tight manner, by means of UV radiation or ion radiation or radioactive radiation.

Furthermore, it is possible, according to the invention, that the connection region between the multi-part packaging is formed by a special film in the manner of a membrane, which means that specific gases can be introduced into the interior of the inserted and sealed multi-part packaging, but that harmful and possibly contaminated air cannot get into the interior of the multi-part packaging through the membrane structure.

In a first exemplary embodiment, the invention proceeds from a preferably two-part packaging, in which an upper, preferably cylindrical packaging sleeve can be inserted into a second packaging sleeve that has approximately the same configuration, with mirror symmetry. In this exemplary embodiment, the two packaging sleeves are open at one face side, in each instance, while the opposite face side is closed off with a bottom.

The invention is not restricted to this. The invention can provide packaging sleeves having any desired profile shape, for example that the two packaging sleeves have a polygonal profile shape or that the two packaging sleeves have any other desired profile shape, wherein it is preferred, however, that the insertion region (hereinafter also called insertion sleeve) between the two packaging sleeves is preferably configured to be cylindrical, in order to thereby allow advantageous and gas-tight sealing of this coverage region.

However, the invention is not restricted to this. In a different embodiment, it can be provided that the connection region between the two packaging sleeves, with which these are inserted into one another and reciprocally overlap there, is not configured to be circular-cylindrical, but rather rectangular, square, oval, triangular or polygonal in general.

From this, it results that it is true that the connection region between the packaging sleeves inserted into one another should preferably be configured to be circular-cylindrical, because this makes sealing of the connection joint particularly simple; however, the invention is not restricted to this.

When a multi-part packaging is being discussed, the invention also provides more than two-part packagings. Thus it can be provided, for example, that two open face sides that are directed in opposite directions are present on a central packaging sleeve, so that closure caps or end sleeves can be set onto both face sides of the center sleeve, and this joint region in the connection region between the center sleeve and the respective set-on end sleeves can be sealed, in air-tight manner, with the sealing film according to the invention.

The same also holds true for any other multi-part packagings that work with closure caps. Here, too, it is provided, in a further development of the invention, that the connection region between the closure cap and the multi-part packaging is sealed, in air-tight manner, with a sealing film according to the invention.

In a preferred embodiment of the invention, the air-tight seal in the connection region of the two packaging sleeves that are inserted into one another consists of a sealing film, which preferably is glued over the connection joint, which extends in the circumference direction, over its full area, and forms an overlap region that occurs in the circumference direction, which region now serves as a sealing space, and in this overlap region, the sealing film is sealed in such a manner that the overlap region is also reliably covered with the sealable adhesive surface, and sealed.

Accordingly, it is important to the invention that in the circumference direction, the sealing film reliably covers and seals the connection joint of the two packaging sleeves, which are connected with one another, which joint extends in the circumference direction, and that in the axial direction, the axial joint that occurs when the sealing film is wound on (overlap joint that occurs in the axial direction) is also reliably sealed.

Here, the invention provides that in the overlap region, additional sealing takes place, which ensures that no air inclusion can occur in the overlap region, but rather an additional sealing space is formed there, which ensures reliable air exclusion, without the risk that air will be enclosed in the overlap of the two sealing surfaces.

In a preferred embodiment of the present invention, the sealing film therefore has heat-sealable sealing surfaces, which are coated with a hot-melt adhesive.

In the case that the sealing film is formed with a hot-melt-capable sealing surface, it is therefore preferred if the sealing film is configured in at least two layers and consists of a neutral support web, which consists, for example, of a paper or a heat-resistant plastic film material, on the inside of which the hot-melt sealing surface according to the invention is now disposed.

In another embodiment of the invention, it can be provided that the hot-melt-capable plastic or adhesive is already integrated into the sealing film itself, in order to thereby prevent application of a hot-melt adhesive onto a neutral support web. The two parts (hot-melt adhesive and support web) are then thereby combined with one another in a single, one-layer film part.

Accordingly, the air-tight seal, which prevents air inclusion in the region of the axial overlap region, in that the sealing surfaces assigned to one another melt into one another and thereby prevent air inclusion, is important to the invention.

The sealing surface on the sealing film can be configured to be either rectangular or in the manner of a frame, wherein a center window is provided, which does not participate in the sealing process.

In another embodiment, it can be provided that the sealing surface is continuous and that the central window region inside the frame is eliminated.

If such a multi-part packaging is provided for packaging medical apparatuses, devices, and instruments, it is preferred if the type and shape of the packaging sleeve is adapted to the object to be packaged.

It is an advantage of the invention that the multi-part packaging consists of hollow blow-molded parts, which guarantee a rich variety in production. Hollow blow-molded items can be produced in cost-advantageous manner and can have a lower wall thickness as compared with items produced using the plastic injection-molding method. In the case of hollow blow-molded items—in contrast to the plastic injection-molding method—indentations can be produced in the interior region, which would not be possible using the plastic injection-molding method. For this reason, lower wall thicknesses are used, with lower plastic consumption, but these also lead to easier formability, and this makes the connection joint between the two parts more difficult to seal. For this reason, sealing, according to the invention, of the axial connection joint of the sealing film leads to reliable sealing of hollow blow-molded articles.

In another embodiment, it is also possible to configure the multi-part packaging as multi-part injection-molded parts.

The object of the present invention is evident not only from the object of the individual claims, but rather also from a combination of the individual claims with one another.

All the information and characteristics disclosed in the documents, including the abstract, particularly the spatial configuration shown in the drawings, are claimed as being essential to the invention, to the extent that they are new, individually or in combination, as compared with the state of the art.

When individual objects are indicated as being "essential to the invention" or "important," this does not mean that these objects must necessarily form the object of an independent claim. This is determined solely by the current version, in each instance, of the independent claim.

In the following, the invention will be explained in greater detail using drawings that merely show one implementation path. In this regard, further characteristics and advantages of the invention are evident from the drawings and their description.

Figure 5:
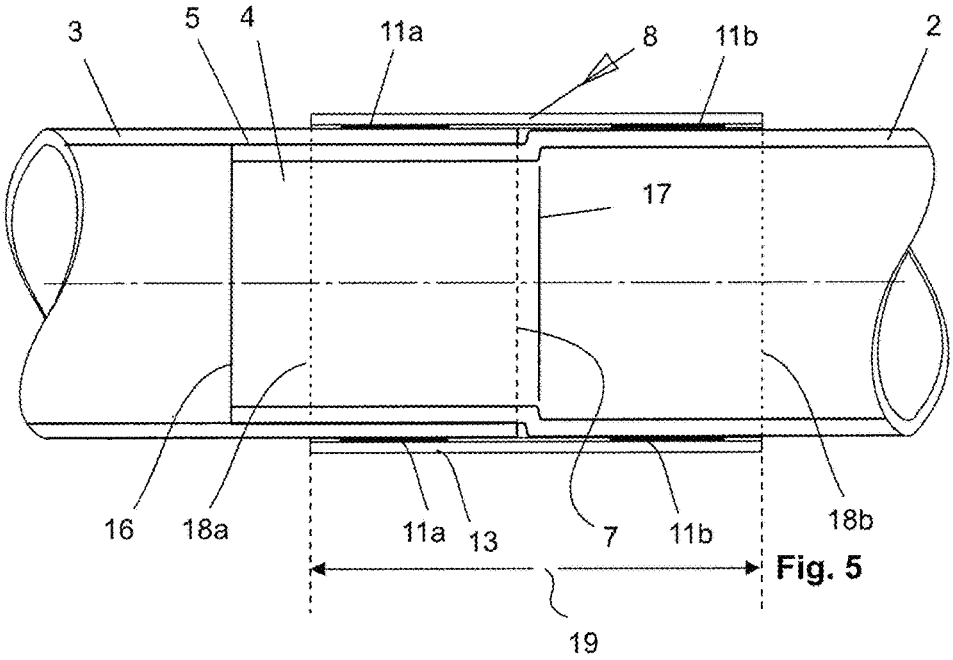
Figure 6:
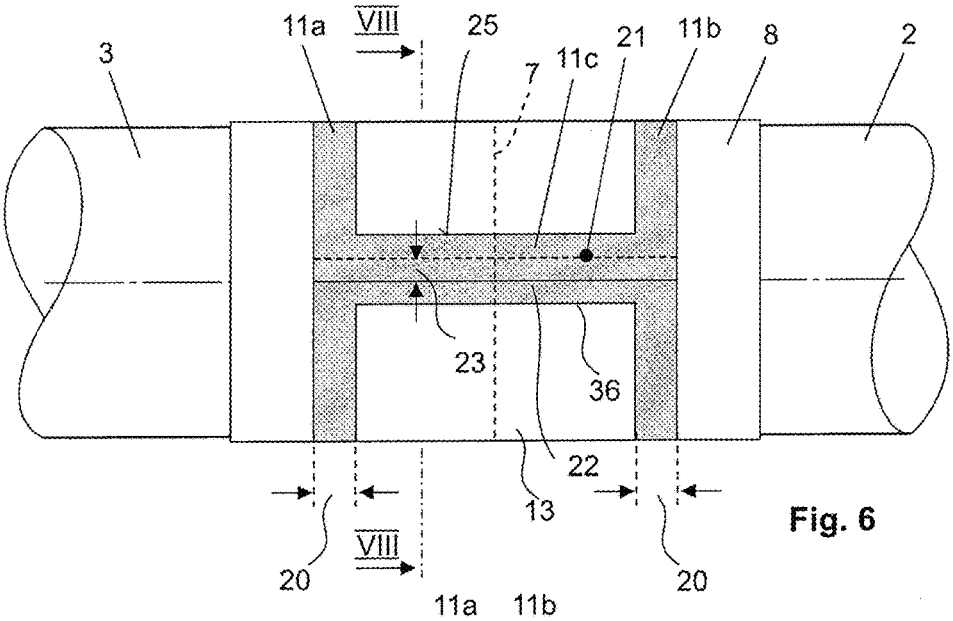
Figure 7:
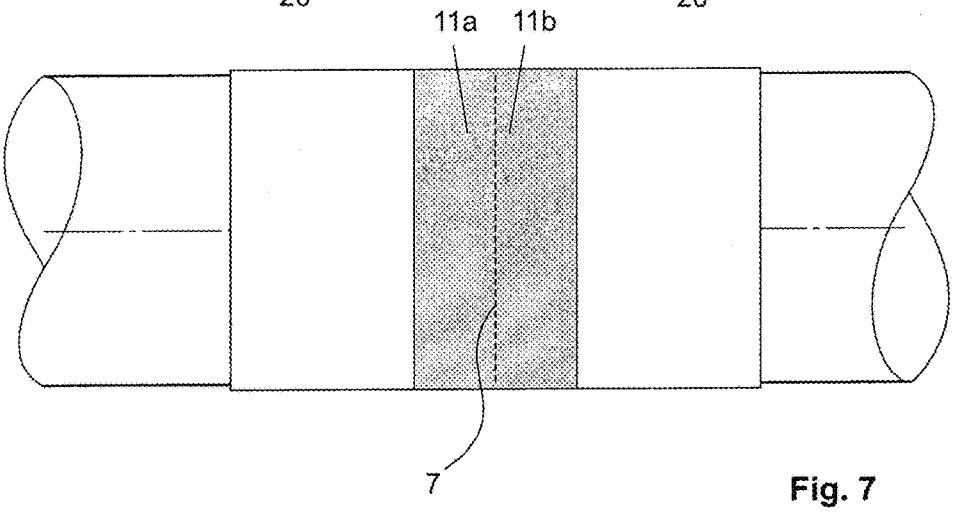
Figure 8:
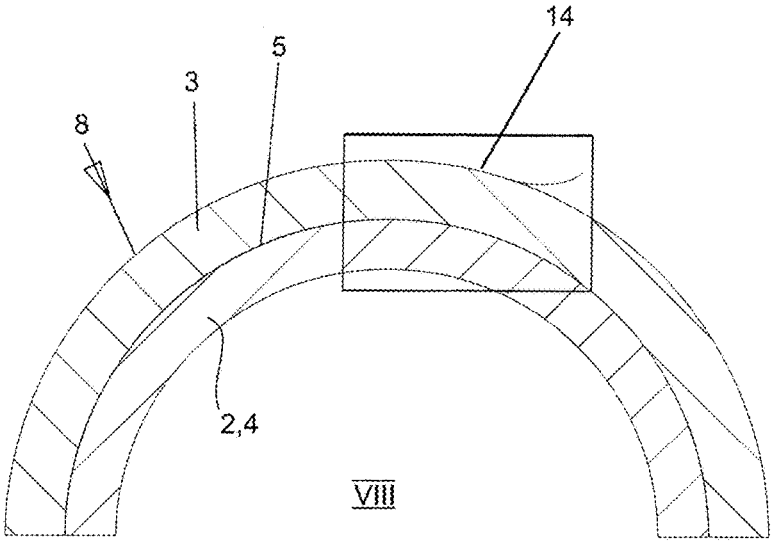
Figure 9:
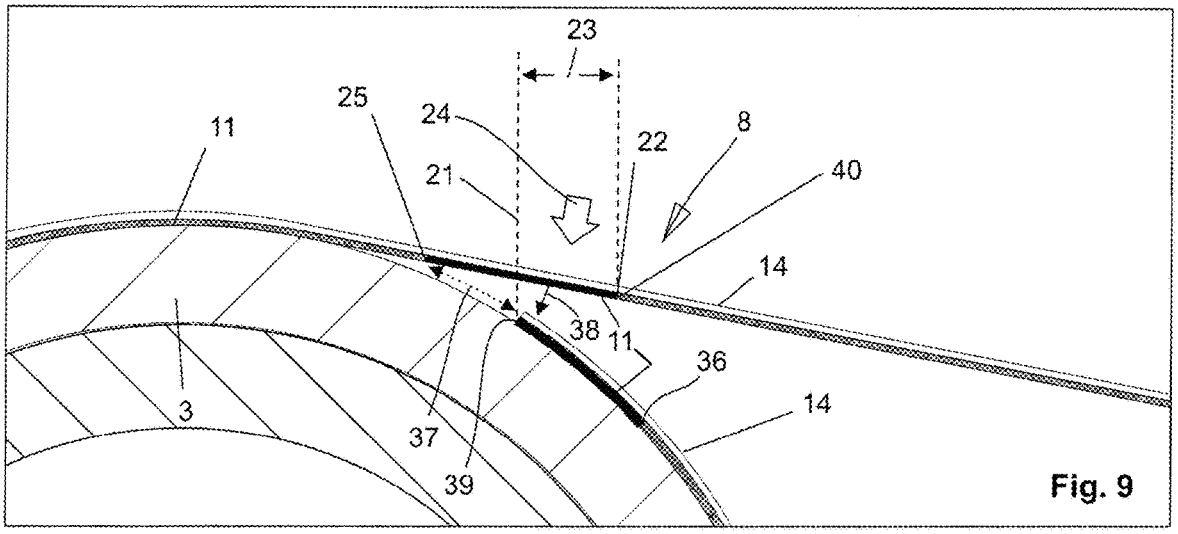
Figure 10:
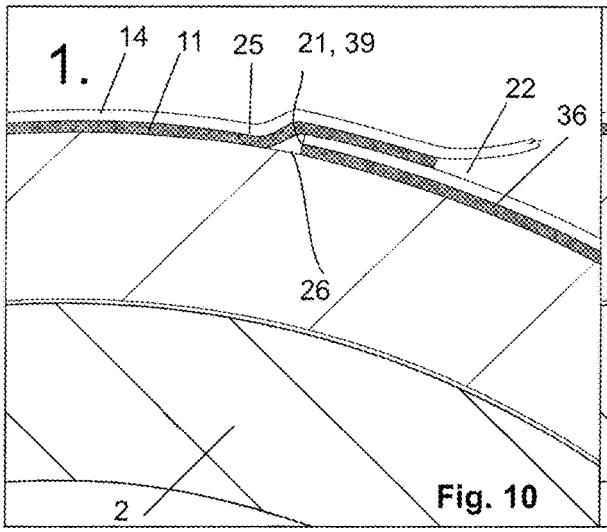
Figure 11:
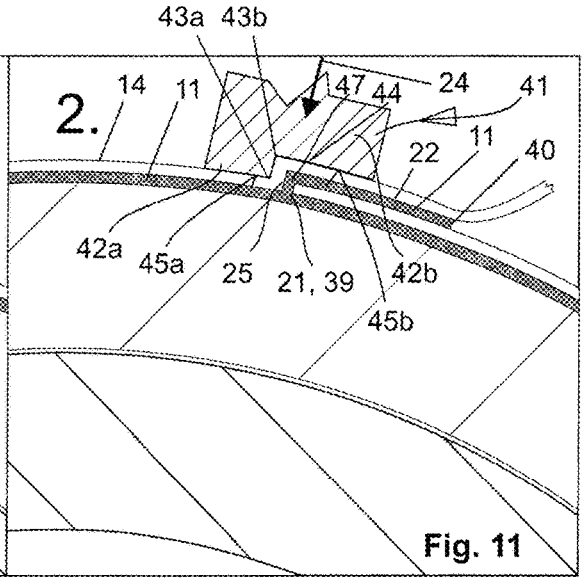
Figure 12:
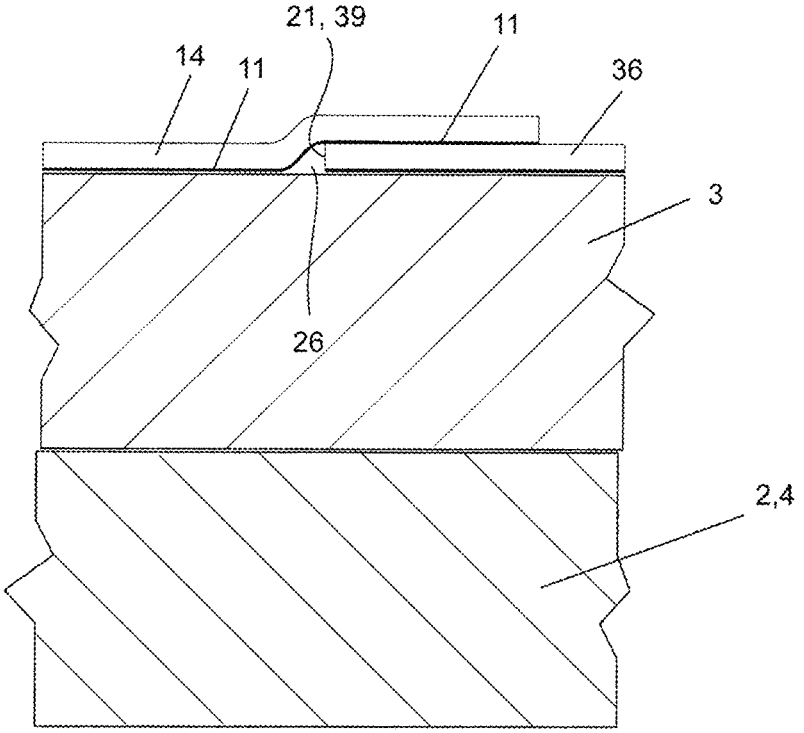
Figure 13:
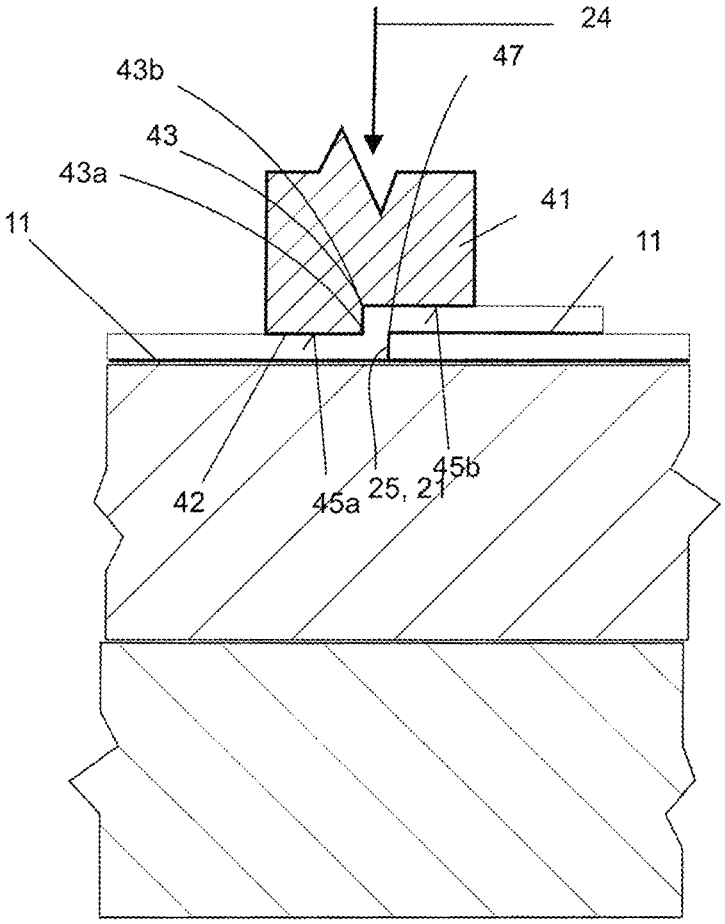
Figure 14:
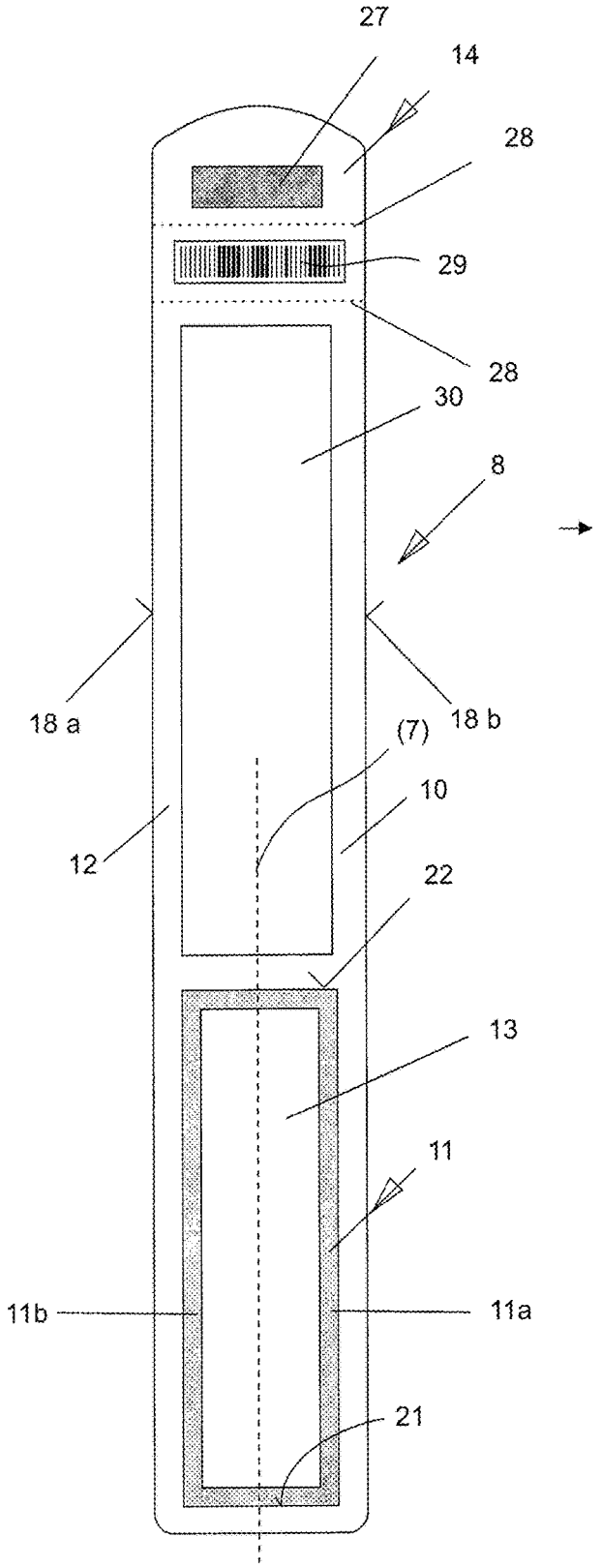
Figure 15:
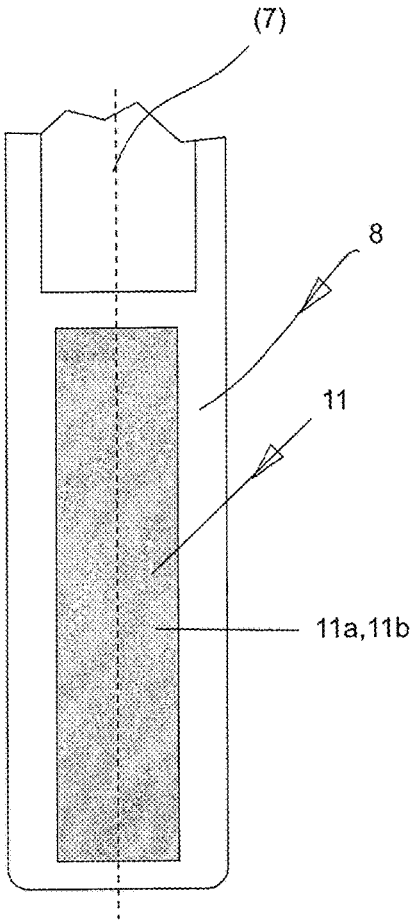
Figure 20:
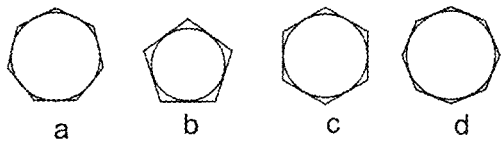
Figure 16:
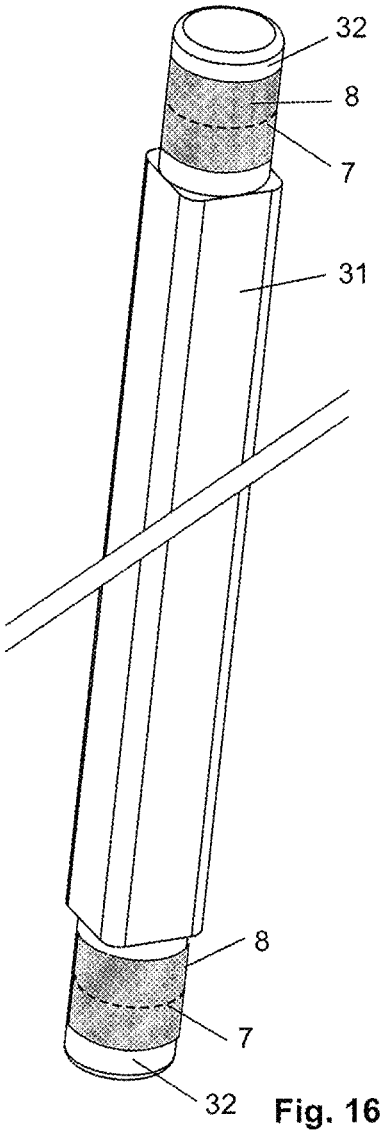
Figure 21:
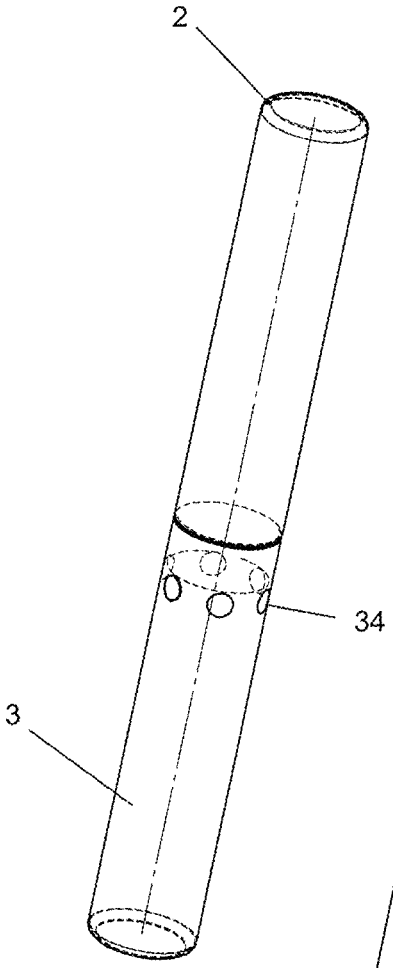
Figure 22:
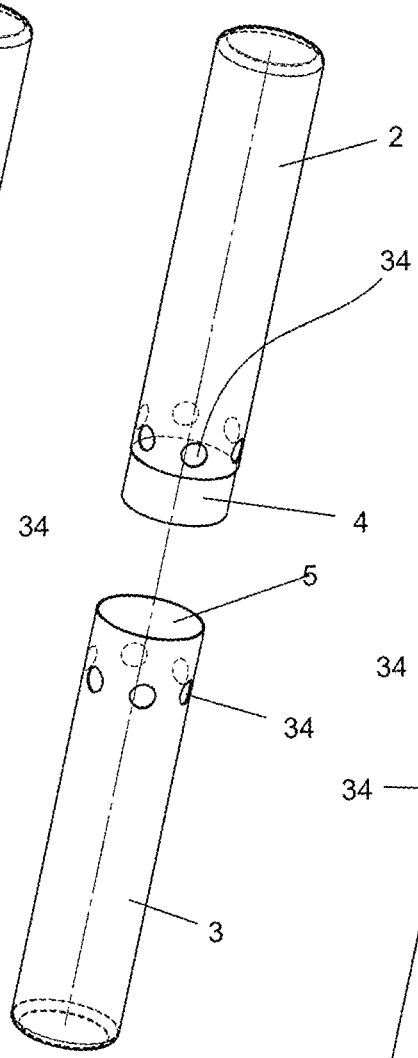
Figure 23:
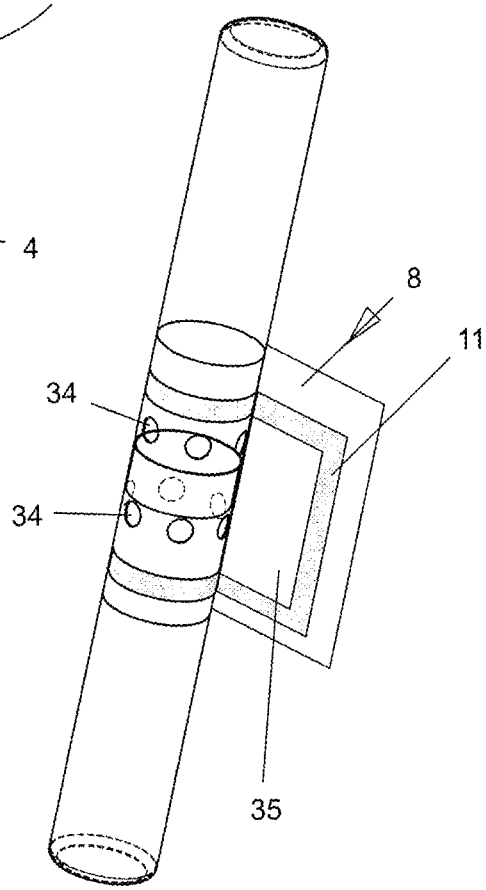
Figure 24:
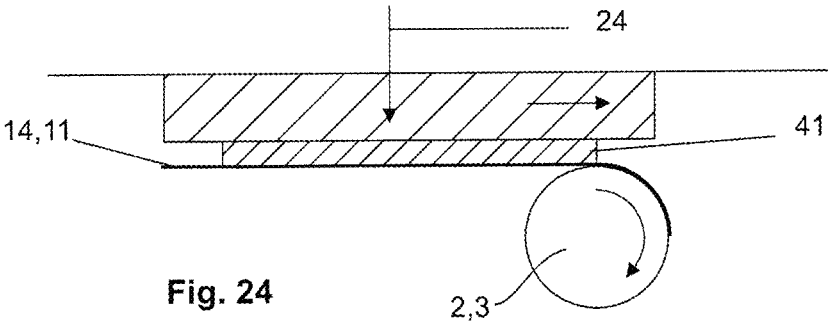

The figures show:

FIG. 1: schematically, a first embodiment of a multi-part packaging in a pulled-apart representation, FIG. 2: the packaging according to FIG. 1 in the inserted state, FIG. 3: the packaging according to FIG. 2 when pulling off a sealing film that has been applied there in air-tight manner, FIG. 4: an exemplary embodiment that is modified as compared with FIG. 3, FIG. 5: the section through the connection joint between the two inserted packaging sleeves according to FIGS. 2 and 3, FIG. 6: the top view of the connection joint according to FIG. 5, FIG. 7: an embodiment modified as compared with FIG. 6, FIG. 8: an overview drawing, in section, through the connection joint between the two packaging sleeves, with a representation of affixation of the sealing film, FIG. 9: an enlarged representation, as compared with FIG. 8, before production of the seal in the region of the overlap, FIG. 10: the representation according to FIG. 9 just before production of the seal, FIG. 11: the representation according to FIG. 10 after production of the seal, FIG. 12: an exemplary embodiment according to FIG. 10, FIG. 13: an enlarged representation of FIG. 11 with further details, FIG. 14: the top view of a sealing film, FIG. 15: an embodiment modified as compared with FIG. 14, FIG. 16: a perspective view of another embodiment of a packaging sleeve, FIG. 17-FIG. 20: the representation of different profile shapes of multi-part packagings, FIG. 21: a further exemplary embodiment as compared with FIG. 3, with packaging sleeves inserted into one another and ventilation bores, FIG. 22: the representation according to FIG. 21 before insertion, FIG. 23: the representation according to FIG. 21 after insertion and sealing of the connection joint, FIG. 24: a method for rolling a seal onto a round sleeve, In FIGS. 1 to 3, a multi-part packaging 1 is shown in general, which, in the exemplary embodiment shown, consists of a round-cylindrical upper packaging sleeve 2, onto which a connection sleeve 4, which is reduced in diameter, is formed.

The upper packaging sleeve 2 can be connected with the lower packaging sleeve 3 in that the two parts are inserted into one another, with shape fit, with application of a friction fit, so that the connection sleeve 4 of the packaging sleeve 2 engages, with shape fit, in an accommodation region 5 of the lower packaging sleeve 3, thereby forming an overlap region 6 between the two packaging sleeves 2, 3.

The shape-fit engagement between the connection sleeve 4, the packaging sleeve 2, and the accommodation region 5 of the packaging sleeve 3, however, is not necessary for the solution. For example, facets or similar projections or locking elements can also be disposed on the connection sleeve 4, because the only important thing, in the sense of the present invention, is to seal the connection joint 7 between the packaging sleeves 2, 3 that have been inserted into one another, in air-tight manner. The connection joint 7 is preferably flush with the surface of the packaging sleeve 2. It is therefore configured to be flush with the wall.

The connection joint 7 is delimited, on its upper part, by the circumference edge 17, which forms the connection sleeve 4 having a reduced diameter with the upper part of the packaging sleeve 2.

FIG. 3 shows that the connection joint 7—which is therefore only shown with a broken line in FIG. 3—is now sealed completely and air-tight both in the circumference direction and in the axial direction, wherein according to the invention, a double seal takes place in the axial overlap region.

For this purpose, a sealing film 8 is used, which consists of a support film 14, on the surface of which a hot-melt-capable adhesive is applied.

It is important that now, a heat-sealing-capable sealing surface 11 is disposed in the interior or on the inside of the sealing film 8, which surface is configured in frame-like manner, like a window, so that both complete overlap of the sealing surfaces 11 in the circumference and a double overlap of the sealing surface 11 in the axial direction take place, when the sealing film engages completely around the outer circumference of the connection joint 7.

In the exemplary embodiment shown, the upper and lower support webs 10, 12 therefore also adhere to the circumference of the two packaging sleeves 2, 3 that have been inserted into one another, and in addition, the region of the support web 13 still disposed in the window region can also cover the connection joint 7 between the two packaging sleeves 2, 3 that is situated in this center region.

This region of the support web 13 can also be coated with a hot-melt adhesive. FIG. 3 furthermore shows that such a sealing film 8 can be pulled off in the direction of the arrow 9, in order to thereby open up the air-tight closure in the region of the connection joint 7 between the packaging sleeves 2, 3 that have been inserted into one another. For this purpose, the sealing film 8 carries an end closure 15 at its free, front end, in the region of the support film 14, which closure serves as a handle and is configured to be adhesive, so that in the finished state of the multi-part packaging 1, sealed in air-tight manner, the end closure 15 lies on the outside of the sealing film 8, in adhesive manner.

FIG. 4 shows, as a further exemplary embodiment, that it is not necessary for the solution that the sealing film 8, with its sealing surface 11, is configured approximately in window shape or frame shape—as shown in FIG. 3. It can also be provided, according to FIG. 4, that the center support web 13 is eliminated and that the two sealing surfaces 11*a*, 11*b* (see FIG. 6) come together and, in total, form a continuous adhesive surface according to FIG. 4.

FIG. 5 shows an axial section through the multi-part, inserted packaging, where it is evident that according to FIG. 3, two sealing surfaces 11*a*, 11*b* are present, which extend in the circumference direction, are completely sealed, and reciprocally overlap on the edge side, which surfaces are disposed to the left and the right, in each instance, of the connection joint 7 to be sealed in air-tight manner.

It can be seen that in the region of the connection joint 7, a dead space or an air space necessarily occurs, which is sealed by means of the measures according to the invention, according to FIG. 6 and FIGS. 9-13, so that there, it is certain that no air can enter or exit any longer.

The width of the sealing film 8 is selected in such a manner that a sufficiently large coverage region 19 exists in the axial direction, in order to thereby allow the most secure possible affixation of the two sealing webs 11*a*, 11*b*, so that these can result in complete and air-tight closure on both sides of the connection joint 7.

In a preferred embodiment, the width of the sealing surfaces 11*a*, 11*b* lies at 6 mm, for example, while a total width (coverage region 19) of the sealing film 8 is from 20 to 25 mm.

The width (coverage region 19) furthermore also depends on other requirements, such as, for example, the creation of text blocks, affixation of additional adhesive surfaces for attaching booklets, and more of the like.

In any case, the two lateral edges 18*a* and 18*b* of the sealing film 8 according to the invention should reliably have a generous distance from the connection joint 7 to be sealed.

FIG. 6, in combination with FIGS. 9 and 10, now shows the double seal of the sealing film 8 in the axial direction.

FIG. 6 shows the finished, sealed state, where, in combination with FIGS. 9 and 10, it is shown that at first, the sealing film 8 is laid against the surface of the packaging sleeve 3 with a first overlap edge 21, and the sealing surface 11 has a specific length in the circumference direction, so that its end edge is referred to as the front edge 36.

When the sealing film 8 is completely wound around, the other, opposite sealing surface 11 therefore occurs at an offset; this surface has a rear edge 25 and an overlap edge 22 configured as a front edge.

When the two sealing surfaces 11-11 are pushed down or pressed down in the direction of the arrow 24 (see FIG. 9), offset coverage of the two sealing surfaces 11-11, relative to one another, thereby occurs, resulting in a sealing space 37 that is now double-sealed, according to the invention. The seal material of the upper sealing web 11 penetrates, in the direction of the arrow 38, in the direction of the sealing surface 11 of the web that lies underneath, and fills this surface. As a result, the sealing space 37 is completely filled, as is shown in FIG. 9, in a method step that occurs shortly before the sealing process is complete. Therefore, a double overlap of the two sealing surfaces 11 occurs in the axial direction of the packaging sleeve in the sealing space 37, thereby resulting in reliable, air-tight closure.

Accordingly, double sealing of a ring region 26 occurs, because the two sealing surfaces 11 are sealed onto one another, and as a result, form an approximately triangular cross-section of the sealing space 37, in cross-section, and thereby complement one another and fill one another out. Air inclusion is therefore prevented, in any case, in this region.

This is evident also from FIG. 6, which shows the finished, sealed state, where it is evident that the overlap edge 21 of the sealing web 11 that lies underneath is offset relative to the overlap edge 22 of the sealing web 11 that lies on top.

This results in a coverage region 23 between the two sealing webs, which region runs in the axial direction, and thereby a double seal in the axial direction is achieved, as is shown in FIG. 9 in combination with FIG. 6.

The seal width 20 in the circumference region of the two sealing surfaces 11*a*, 11*b* amounts to preferably about at least 6 mm, and the double sealing width, which the horizontal sealing surface 11*c* forms in FIG. 6, has at least a width of 9 mm. It holds true that the sealing width is 6+6/2=9 mm.

In FIG. 5, it is also indicated, merely for the sake of completeness, that the lower face edge of the connection sleeve 4 is referred to as the face side 16, while the upper face edge is referred to as the circumference edge 17.

FIG. 7 shows that the window region with the center support web 13, according to FIG. 6, can also be eliminated, and the two sealing surfaces 11*a* and 11*b* that run in the circumference direction can also coincide, so that the double, sealed region according to FIG. 6 then coincides with the support webs 11*a*, 11*b*.

FIG. 8, as an overview drawing, shows the affixation of the sealing film 8 according to the invention, while FIGS. 9 to 11 show further details.

FIG. 10 shows the overlapping sealing films, where it is evident that in the region of an overlap edge 21, the starting edge 39 of the sealing film lies underneath the sealing surface that lies on top, and that in this region, an air-filled ring region 26 is formed, which is undesirable and should be removed if at all possible.

The ring region 26 (corresponds to the sealing space 37) is initially filled with air and is supposed to be removed by means of the measures according to the invention. This means that no air is supposed to be present there any longer, which air might possibly penetrate into the interior of the multi-part packaging.

While FIGS. 9 and 10 describe removal of the sealing space 37 possibly filled with air (in the ring region 26) only by means of having a hot-melt-capable sealing surface 11 flow into this sealing space 37, FIGS. 11 to 13 describe a further exemplary embodiment, in which a stepped sealing punch 41 is used for closure of the sealing space 37.

FIG. 11 shows a tool suitable for this purpose, which is configured as a sealing punch 41 that is configured in multiple steps.

The sealing punch has two locating faces 42*a*, 42*b* that lie one behind the other in the circumference direction, wherein the locating face 42*a* projects radially further than the locating face 42*b*, in comparison.

The two locating faces 42*a*, 42*b* form sealing surfaces 45*a*, 45*b*, in the direction toward the sealing surface, which surfaces—in the exemplary embodiment shown—are configured as straight surfaces and lie tangentially against the outer circumference of the support film 14.

In another embodiment of the invention, it can be provided that the sealing surfaces 45*a*, 45*b* do not lie tangentially against the outer circumference of the curved support film 14, but rather that they have the same curvature as the curvature of the wall of the packaging sleeve 2, 3, in order to lie against the surface of the support film 14 and of the packaging sleeve 2, 3 with shape fit.

However, tangential contact of the sealing surfaces 45*a*, 45*b* is preferred, because the sealing punch 41 moves perpendicular to the drawing plane of FIGS. 10 and 11 during sealing, and, during this process, the entire packaging sleeve 2, 3 is mounted, so as to rotate, on a suitable bearing shell (not shown in the drawing), so that the packaging sleeve unwinds under the sealing punch 41, which runs along with it, and, during this process, the sealing punch 41 performs step sealing according to FIGS. 11 and 13 with its two locating faces 42*a*, 42*b*, which are offset from one another, seen in the radial direction of the packaging sleeve.

This is achieved in that a step 43 is disposed at the transition between the radially longer locating face 42*a* and the radially shorter locating face 42*b*, which step is formed by a front edge 43*a* and a rear edge 43*b*.

The step 43, in its longitudinal expanse, is aligned approximately perpendicular to the surface of the packaging sleeve 2.

In another embodiment, however, it can also be provided that the longitudinal expanse of this step 43 is aligned at an angle to the surface of the packaging sleeve 2, 3.

The sealing punch 41 is then positioned, with its step 43, in such a manner that the step 43 gets into the opposite position from the overlapping joint of the two sealing surfaces, i.e. into the region of the overlap edge 21 of the lower sealing film. The longitudinal expanse (length) of the sealing punch 41, which extends in the axial direction of the packaging sleeve, approximately corresponds to the axial length of the sealing seam, which also extends in the axial direction, with the overlap step 47 according to the invention.

In this way—as shown in FIG. 11—an overlap step 47 that extends in the axial direction is formed between the two sealing surfaces, which are welded to one another in air-tight manner, so that it is evident that the starting edge 39 of the lower sealing film is connected with the transition region of the left film in air-tight, shape-fit, and sealing manner, and, as a result, the ring region 26 indicated above, which could possibly be filled with air, has now completely disappeared.

The same conditions on an enlarged scale are shown once again in FIGS. 12 and 13. The same explanations apply for the same reference symbols.

Particularly in the transition from FIG. 12 to FIG. 13, it is evident that now, the undesirable ring region 26, which was previously filled with air, is now configured as an overlap step 47, and that the two sealing surfaces are connected with one another in air-tight manner. The air-tight overlap step 47 extends over the entire axial length of the seal, and this makes it clear that no air inclusions of any kind are present in this ring region 26 any longer, because the ring region 26 was transformed into an overlap step 47 configured in shape-fit and sealed manner.

From the above description, it is evident that a first possibility for eliminating the ring region 26 exists when using a sealing punch 41 provided with the radial locating faces 42*a*, 42*b*.

In another embodiment, the stepped sealing punch can be eliminated, and the ring region 26 in FIG. 12 can be made to disappear in that melt-capable sealing masses having a greater thickness, at least in this region, are used, so that these flow into one another with a greater volume, and the ring region 26 is completely closed off in its axial length, because the triangular contour is filled with the sealing masses, which flow into one another, and is thereby also sealed in air-tight manner (see FIG. 9).

The more reliable variant, however, is the use of a stepped sealing punch 41, although the invention is also directed at the use of sealing masses, which flow into one another with shape fit, in such a manner that a material connection occurs in the area of the ring region 26, which connection entirely removes the ring region 26 and makes any air inclusions there disappear.

In a first embodiment, the axial length of the sealing punch 41 approximately corresponds to the axial length of the overlap step 47, so that for its production, the sealing punch only has to be set onto the overlap step, which faces in the axial direction and causes it to melt.

In a second embodiment, the axial length of the sealing punch 41 can be configured to be shorter than the axial length of the overlap step 47. In this case, either the packaging sleeve 2, 3 and/or the sealing punch 41 is/are moved relative to the overlap step 47, in the axial direction, in order to successively apply the double melt seal in the region of the overlap step 47, in the axial direction.

FIG. 14 shows the preferred embodiment of such a sealing film 8. It has an approximately oblong, rectangular shape, but the invention is not restricted to this.

The sealing film 8 can have any desired shape; it can be configured to be oval, rectangular, square or any desired other shape. It is shown merely as an example that the sealing surface 11 is applied in approximately rectangular and frame-shaped, window-like form, so that the two sealing surfaces 11*a*, 11*b*, which run in the circumference direction, are spaced apart from one another. It was already indicated above, in connection with FIG. 7 and also subsequently in connection with FIG. 15, that this window region 13 can also be eliminated, and that the two sealing surfaces 11*a*, 11*b* can also coincide. This is shown in FIG. 15.

Furthermore, the sealing film 8 in FIG. 11 has the support film 14, in the upper region of which a releasable seal 27 is disposed. Underneath that, a perforation line 28 or also multiple perforation lines 28 that run parallel to one another can be present, which lines enclose a documentation barcode 29 between them. As a result, not only can the releasable seal 27 be torn off, but so can the documentation barcode 29.

The text field 30 that follows can be provided with an imprintable text.

It is important that a rectangular sealing surface 11 is present, which is shown in FIG. 14, so that this surface is suitable for completely covering the connection joint 7 over its full area; this joint is shown in the drawing merely as an example.

FIGS. 16 to 20 show further embodiments of a multi-part packaging 1. The multi-part packaging 1 shown in FIG. 16 consists of a center sleeve 31, on the face sides of which connection sleeves are disposed on both sides, in each instance, onto which related end sleeves 32 are set. Here, too, the connection joint 7 is sealed, in air-tight manner, with the sealing film 8 according to the invention, in each instance.

Figure 17:
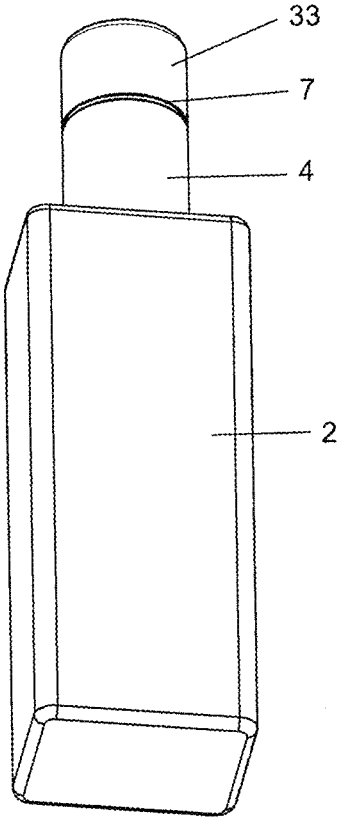

FIG. 17 shows a multi-part packaging, in which the connection sleeve 4 is covered with a closure cap 33 on its open side, which cap can also be sealed off, in complete and air-tight manner, using the sealing film 8 according to the invention.

Figure 18:
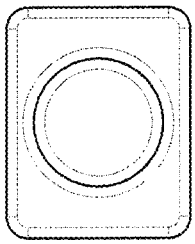
Figure 19:
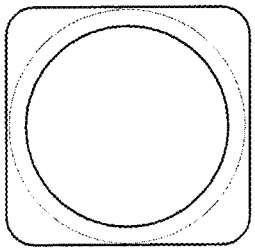

FIGS. 18 to 20 show different profile shapes of such packaging sleeves 2, 3 of multi-part packagings 1, wherein the invention remains entirely free to use a specific profile shape. However, it is preferred if the connection sleeve 4, which is used for making the connection with the opposite packaging part, is preferably configured to be round-cylindrical. However, the invention is not restricted to this, as was mentioned initially.

FIGS. 21 to 23 show, as a further exemplary embodiment, a type of packaging sleeve 2, 3 as described using the previous FIGS. 1 to 20.

Here, each packaging sleeve 2, 3 is provided with ventilation bores 34 outside of the overlap region of the packaging sleeves 2, 3 that have been inserted into one another. In this manner, it is possible to seal off the connection joint in air-tight manner, as shown in FIG. 20, where the ventilation bores 34, however, are disposed in the window-like cut-out of the sealing film 8.

Accordingly, the ventilation bores 34 lie in a window region 35 of the sealing film 8, and this window region 35 is configured in the manner of a membrane, which ensures that specific gases—particularly inert gases or gases for sterilization—can get through the window region 35 of the sealing film 8 into the interior of the packaging sleeve 2, 3, so that feed of air through the ventilation bores is not possible. Furthermore, the gas introduced by way of the ventilation bores is no longer supposed to be able to escape from the interior of the packaging, which has been sealed in heat-sealed manner.

Accordingly, what is involved here are membrane files that are configured in valve-like manner, through which an air stream can be passed in but can no longer escape.

Sealing of the sealing film 8 on the multi-part packaging 1 can take place by way of all known sealing methods; in particular, sealing can take place with a hot-melt adhesive, to which energy is applied by way of a radiation source or an ultrasound sonotrode. Likewise, rolling seals or sealing methods that work with heated pressing tools can be used. In all the exemplary embodiments described above, the rolling-seal method is preferred. This method uses a heated punch, which rolls along the outer circumference of the object to be sealed with its sealing surface, which is preferably configured to be straight.

FIG. 24 shows a rolling-seal method on a round packaging sleeve 2, 3, in which the connection joint 7, having a sealing surface 11, is sealed using a sealing punch 41.

DRAWING KEY

1 multi-part packaging
2 packaging sleeve (top)
3 packaging sleeve (bottom)
4 connection sleeve (of 2)
5 accommodation region (of 3)
6 overlap region
7 connection joint
8 sealing film
9 arrow direction
10 support web (top)
11 sealing surface a, b, c
12 support web (bottom)
13 support web (center)
14 support film
15 end closure
16 face side
17 circumference edge
18 edge a, b
19 coverage region
20 seal width
21 overlap edge
22 overlap edge
23 coverage region
24 arrow direction
25 rear edge
26 ring region
27 releasable seal
28 perforation line
29 documentation barcode
30 text field
31 center sleeve
32 end sleeve
33 closure cap
34 ventilation bore
35 window region
36 front edge
37 sealing space
38 arrow direction
39 starting edge
40 end edge
41 sealing punch
42*a* locating face
42*b* locating face
43 step
43*a* front edge
43*b* rear edge
44
45*a* sealing surface
45*b* sealing surface
46
47 overlap step

The invention claimed is:

1. A multi-part packaging comprising:

a first packaging sleeve that has a longitudinal dimension and a diameter dimension, the first packaging sleeve also having a face side that defines a profile and a circumferential edge located longitudinally away from the face side, the first packaging sleeve defining a connection sleeve between the face side and the circumferential edge with the connection sleeve having a diameter dimension that is less than the diameter dimension of the first packaging sleeve;

a second packaging sleeve that has a longitudinal dimension and a diameter dimension, the second packaging sleeve having a longitudinal end that defines an accommodation region with a profile corresponding to the profile of the face side of the first packaging sleeve such that the connection sleeve of the first packaging sleeve is insertable in the accommodation region of the second packaging sleeve and, at times when the connection sleeve is inserted in the accommodation region, the first packing sleeve cooperates with the second packaging sleeve to establish a connection joint between the circumferential edge of the first packaging sleeve and the longitudinal end in the accommodation region of the second packaging sleeve; and a sealing film comprising a starting edge, an ending edge, and a length that is greater than the diameter dimension of the second packing sleeve, wherein the sealing film is located and sealed over the connection joint such that a first overlap edge comprising the ending edge covers a second overlap-edge comprising the starting edge to define a coverage region that runs in the longitudinal dimension of the first and second packaging sleeves, wherein a rear edge of the first overlap edge conforms to the starting edge of the second overlap edge forming an overlap step that is radially offset to provide an air-tight seal against the starting edge that runs in an axial direction.

2. The multi-part packaging of claim 1, wherein the sealing film comprises a support film with a hot-melt adhesive applied to a surface of the support film.

3. The multi-part packaging according to claim 2, wherein a first portion of the support film of the sealing film in which hot-melt adhesive is applied defines a first edge-side sealing surface and wherein a second portion of the support film of the sealing film in which hot-melt adhesive is applied defines a second edge-side sealing surface, the first edge-side sealing surface extending circumferentially on the first packaging sleeve at a longitudinal location on the first packaging sleeve apart from the connection joint, the first edge-side sealing surface sealed to the first packaging sleeve with an air-tight seal, and the second edge-side sealing surface extending circumferentially on the second packaging sleeve at a longitudinal location on the second sleeve apart from the connection joint, the second edge-side sealing surface sealed to the second packaging sleeve with an air-tight seal, the first edge-side sealing surface and the second edge-side sealing surface having first and second ends that form the air-tight seal against the starting edge of the second overlap edge of the sealing film that runs in the axial direction.

4. The multi-part packaging of claim 2, wherein a first portion of the support film of the sealing film in which no hot-melt adhesive is applied defines an upper support web and wherein a second portion of the support film of the sealing film in which no hot-melt adhesive is applied defines a lower support web and wherein a third portion of the support film that is located between upper and lower support webs defines a center region, the upper support web adhering to a peripheral surface of the first packaging sleeve, the lower support web adhering to a peripheral surface of the second packaging sleeve, and the center region adhering to the peripheral surfaces of the first and second packaging sleeves and also covering the connection joint.

5. The multi-part packaging of claim 1, wherein the sealing film includes a heat-seal-capable sealing surface located on a side of the sealing film that faces the first and second packaging sleeves, the heat-seal-capable sealing surface being configured in a frame-like manner, or in the manner of a window, on both sides of the connection joint and including the coverage region, wherein the heat-seal-capable sealing surface of the sealing film engages completely around the first and second packaging sleeves at longitudinal locations apart from the connection joint.

6. The multi-part packaging of claim 5, wherein the second overlap edge of the sealing film includes an end of the heat-seal-capable sealing surface, the offset comprising a portion of the heat-seal-capable sealing surface that is located adjacent the first overlap edge of the sealing film, the offset cooperating with the end of the heat-seal-capable sealing surface that is included in the second overlap edge to form the air-tight seal.

7. The multi-part packaging of claim 1, wherein the first overlap edge includes a heat-seal-capable sealing surface and the second overlap edge also includes a heat-seal-capable sealing surface, the heat-seal-capable sealing surface of the second overlap edge being offset relative to the heat-seal-capable sealing surface of the first overlap edge such that the heat-seal-capable surface of the first overlap edge cooperates with the heat-seal-capable surface of the second overlap edge within the coverage region to define a double seal that is oriented in the longitudinal direction of the multipart packaging.

8. The multi-part packaging of claim 1, wherein a stepped sealing punch is used to form the air-tight seal in the coverage region.

9. The multi-part packaging of claim 1, wherein the first overlap edge of the sealing film conforms to the starting edge of the second overlap edge forming a sealing surface thereon that is approximately perpendicular to a peripheral surface of the multi-part packaging.

10. The multi-part packaging of claim 1, wherein the sealing film includes a heat-seal-capable sealing surface located on a side of the sealing film that faces the first and second packaging sleeves, the heat-seal-capable sealing surface being configured continuously over an area on both sides of the connection joint and including the coverage region, wherein the heat-seal-capable sealing surface of the sealing film engages completely around the first and second packaging sleeves.

11. The multi-part packaging of claim 1, wherein the sealing film further comprises a support film length that extends beyond the first overlap edge.

12. The multi-part packaging of claim 11, wherein the support film length extending beyond the first overlap edge of the sealing film comprises a documentation barcode, a text field, or both.

13. The multi-part packaging of claim 11, wherein the support film that extends beyond the first overlap edge of the sealing film comprises a releasable seal or end closure configured to attach to an outside of the sealing film.

14. A multi-part packaging comprising:

a first packaging sleeve having a longitudinal dimension and a diameter dimension, the first packaging sleeve including a first closed end and a second open end, and a connection sleeve adjacent the second open end, wherein the connection sleeve has a diameter dimension that is less than the diameter dimension of the first packaging sleeve;

a second packaging sleeve having a longitudinal dimension and a diameter dimension, the second packaging sleeve having a first open end and a second closed end, and an accommodation region adjacent the first open end, wherein the accommodation region has a profile corresponding to a profile of the connection sleeve of the first packaging sleeve so that the connection sleeve of the first packaging sleeve is insertable in the accommodation region of the second packaging sleeve and, at times when the connection sleeve is inserted in the accommodation region, the first packing sleeve cooperates with the second packaging sleeve to establish a connection joint therebetween; and a sealing film that provides an air-tight seal over the connection joint, the sealing film having a starting edge in a second overlap edge, and a first overlap edge that covers the second overlap edge to define a coverage region that runs in the longitudinal dimension of the first and second packaging sleeves, wherein the sealing film comprises a heat-seal-capable sealing surface located on a side of the sealing film that faces a peripheral surface of the first and second packaging sleeves, wherein the first overlap edge of the sealing film conforms to the starting edge of the second overlap edge forming a sealing surface thereon that is approximately perpendicular to the peripheral surface of the multi-part packaging to provide an air-tight seal against the starting edge that runs in an axial direction, and wherein the sealing film further comprises a support film length that extends beyond the first overlap edge, the support film having a width substantially the same as the sealing film.

15. The multi-part packaging of claim 14, wherein the support film length extending beyond the first overlap edge of the sealing film comprises a documentation barcode, a text field, or both.

16. The multi-part packaging of claim 14, wherein the support film length extending beyond the first overlap edge of the sealing film comprises a releasable seal or end closure adjacent an end of the support film distal from the starting edge, wherein the releasable seal or end closure is configured to attach to an outside of the sealing film.

17. The multi-part packaging of claim 14, wherein the heat-seal-capable sealing surface is configured in a frame-like manner, or in the manner of a window, on both sides of the connection joint and including the coverage region, wherein the heat-seal-capable sealing surface of the sealing film engages completely around the first and second packaging sleeves at longitudinal locations apart from the connection joint.

18. The multi-part packaging of claim 14, wherein the heat-seal-capable sealing surface is configured continuously over an area on both sides of the connection joint and including the coverage region, wherein the heat-seal-capable sealing surface of the sealing film engages completely around the first and second packaging sleeves.

19. The multipart packaging of claim 18, wherein the heat-seal-capable sealing surface of the sealing film does not extend to longitudinal edges of the sealing film.

* * * * *